US010471300B2

(12) United States Patent
Chen

(10) Patent No.: US 10,471,300 B2
(45) Date of Patent: Nov. 12, 2019

(54) ELLIPTICAL TRAINER

(71) Applicant: JOONG CHENN INDUSTRY CO., LTD., Nantou, Nantou County (TW)

(72) Inventor: James Chen, Nantou (TW)

(73) Assignee: JOONG CHENN INDUSTRY CO., LTD., Nantou, Nantou County (TW)

( * ) Notice: Subject to any disclaimer, the term of this patent is extended or adjusted under 35 U.S.C. 154(b) by 127 days.

(21) Appl. No.: 15/904,007

(22) Filed: Feb. 23, 2018

(65) Prior Publication Data

US 2019/0232107 A1 Aug. 1, 2019

(30) Foreign Application Priority Data

Jan. 31, 2018 (TW) ..... 107103452 A

(51) Int. Cl.
*A63B 22/06* (2006.01)
*A63B 21/22* (2006.01)

(52) U.S. Cl.
CPC ..... *A63B 22/0664* (2013.01); *A63B 21/225* (2013.01); *A63B 2022/0676* (2013.01)

(58) Field of Classification Search
None
See application file for complete search history.

(56) References Cited

U.S. PATENT DOCUMENTS 7,223,209 B2 * 5/2007 Lee ..... A63B 22/001 482/52
7,276,017 B2 * 10/2007 Chen ..... A63B 22/001 482/52
7,316,633 B2 * 1/2008 Liao ..... A63B 22/001 482/52
7,435,204 B2 * 10/2008 Wu ..... A63B 22/001 482/51
8,840,529 B2 * 9/2014 Chen ..... A63B 22/001 482/52
8,979,713 B2 * 3/2015 Huang ..... A63B 22/04 482/51
9,044,640 B2 * 6/2015 Lo ..... A63B 22/0664
9,050,485 B2 * 6/2015 Huang ..... A63B 22/001
2004/0053748 A1 * 3/2004 Lo ..... A63B 22/0007 482/52
2008/0139366 A1 * 6/2008 Born ..... A63B 22/0664 482/52
2008/0167165 A1 * 7/2008 Liao ..... A63B 22/001 482/52
2009/0124463 A1 * 5/2009 Chen ..... A63B 22/001 482/52

(Continued)

*Primary Examiner* — Stephen R Crow
(74) *Attorney, Agent, or Firm* — Muncy, Geissler, Olds & Lowe, PC

(57) ABSTRACT

An elliptical trainer includes a base frame, a front upright frame mounted at the front side of the base frame, a transmission device set mounted at the front upright frame, a guide rail device set including a guide rail seat pivotally connected with its rear side to the rear side of the base frame, an upper support unit affixed to the front side of the guide rail seat and a lower support unit pivotally connected to the front side of the guide rail seat and biasable up and down relative to the front side of the guide rail seat, a retractable device set pivotally connected between the upper support unit and the lower support unit, and a pedal device set connected to the transmission device set and slidably supported on the guide rail seat.

10 Claims, 6 Drawing Sheets

(56) References Cited

U.S. PATENT DOCUMENTS

| | | | | |
|---|---|---|---|---|
| 2014/0194253 | A1* | 7/2014 | Huang | A63B 22/001 482/52 |
| 2015/0182787 | A1* | 7/2015 | Liu | A63B 22/001 482/52 |

* cited by examiner

ELLIPTICAL TRAINER

BACKGROUND OF THE INVENTION

1. Field of the Invention

The present invention relates to exerciser technology and more particularly, to an elliptical trainer.

2. Description of the Related Art

Elliptical trainer is a popular sports fitness equipment in recent years. It generally refers to means that can guide the left and right pedals to move along an approximately oval trajectory so that the user can simulate walking, running, mountain climbing and stair climbing stairs and other legs exercises.

Most commercially available elliptical trainers have a constant elliptical trajectory when the pedals are actuated. Although the user can change the exercise load by adjusting the damping system, the pedal trajectory remains unchanged, i.e., the leg movement pattern is fixed, so, it not only cannot meet the user's preferred form of exercise, but also makes the exercise process boring due to lack of change.

In contrast, conventional elliptical trainers are less modified for pedal trajectory adjustment, so conventional elliptical trainers still have their inconveniences to be improved.

SUMMARY OF THE INVENTION

The present invention has been accomplished under the circumstances in view. It is the main object of the present invention to provide an elliptical trainer, which allows adjustment of the trajectory and height of the pedals to meet different training needs and to enhance the richness of the training contents.

To achieve this and other objects of the present invention, an elliptical trainer comprises a base frame, a front upright frame, a transmission device set, a guide rail device set, a retractable device set and a pedal device set. The base frame defines a front side and an opposing rear side. The front upright frame is mounted at the front side of the base frame and extends upwards. The transmission device set is mounted at the front upright frame. The guide rail device set is disposed within the base frame, comprising a guide rail seat, an upper support unit and a lower support unit. The guide rail seat has a rear side thereof pivotally connected to the rear side of the base frame for allowing the guide rail seat to be biased up and down relative to the rear side of the base frame. The upper support unit is fixedly connected to the front side of the guide rail seat. The lower support unit is pivotally connected to the front side of the guide rail seat and biasable up and down relative to the front side of the guide rail seat. The retractable device set has two opposite ends thereof respectively pivotally connected to the upper support unit and the lower support unit. The retractable device set is retractable to adjust the upward and downward pivoting angle of the guide rail seat relative to the rear side of the base frame. The pedal device set is connected to the transmission device set and slidably supported on the guide rail seat.

Preferably, the upper support unit extends obliquely upwards toward the front side of the base frame; the lower support unit extends toward the front side of the base frame; the retractable device set is disposed between the upper support unit and the lower support unit.

Preferably, the upper support unit comprises an upper support member. The upper support member comprises a connection segment and an extension segment. The connection segment has a bottom end thereof fixedly connected to the front side of the guide rail seat, and an opposing top end obliquely upwardly extending toward the front side of the base frame. The extension segment is fixedly connected to the top end of the connection segment and extends transversely toward the front side of the base frame. The retractable device set is pivotally connected to the extension segment.

Preferably, the upper support unit further comprises an intermediate support member. The intermediate support member has two opposite ends thereof respectively fixedly connected to the front side of the guide rail seat and the extension segment.

Preferably, the lower support unit comprises two lower support members and a connection member. The two lower support members are spaced from each other by a predetermined distance and pivotally connected to the front side of the guide rail seat. The connection member has two opposite ends thereof respectively fixedly connected to the two lower support members. The retractable device set is pivotally connected to the connection member.

Preferably, the lower support unit further comprises two rollers respectively pivotally connected to one respective lower support member.

Preferably, the retractable device set comprises a power unit pivotally connected to the upper support unit, and a retractable bar coupled to the power unit. The power unit is adapted for driving the retractable bar and controlling the extending length of the retractable bar. The retractable bar is pivotally connected with one end thereof to the lower support unit.

Preferably, the guide rail seat comprises a front rod member, a rear rod member and a plurality of slide rods. The rear rod member is disposed transversely, having two opposite ends thereof pivotally connected to the rear side of the base frame. Further, each slide rod has a rear end thereof fixedly connected to the rear rod member and an opposing front end thereof fixedly connected to the front rod member. The upper support unit is fixedly connected to the front rod member. The lower support unit is pivotally connected to the front rod member. The pedal device set is slidably supported on the slide rods.

Preferably, the base frame comprises a front connection bar, a rear connection bar and two side bars. The two side bars have a respective front end thereof respectively connected to two opposite ends of the front connection bar, and a respective opposing rear end thereof respectively connected to two opposite ends of the rear connection bar. The rear rod member has the two opposite ends thereof pivotally connected to the rear connection bar. The front upright frame is fixedly connected to the front connection bar.

Preferably, the base frame further comprises a baffle bar transversely disposed below the slide rods, having two opposite ends thereof respectively connected to the two side bars.

Thus, by means of the power unit to extend out or retract the retractable bar, the pivoting angle of the lower support unit relative to the guide rail seat is relatively adjusted, causing the guide rail seat to be lifted or lowered. Since the pedal device set is slidably supported on the guide rail seat, the trajectory formed by the movement of the pedal device set can be changed to satisfy user different training needs and to enhance the richness of the training contents.

Other advantages and features of the present invention will be fully understood by reference to the following specification in conjunction with the accompanying drawings, in which like reference signs denote like components of structure.

DETAILED DESCRIPTION OF THE INVENTION

Figure 1:
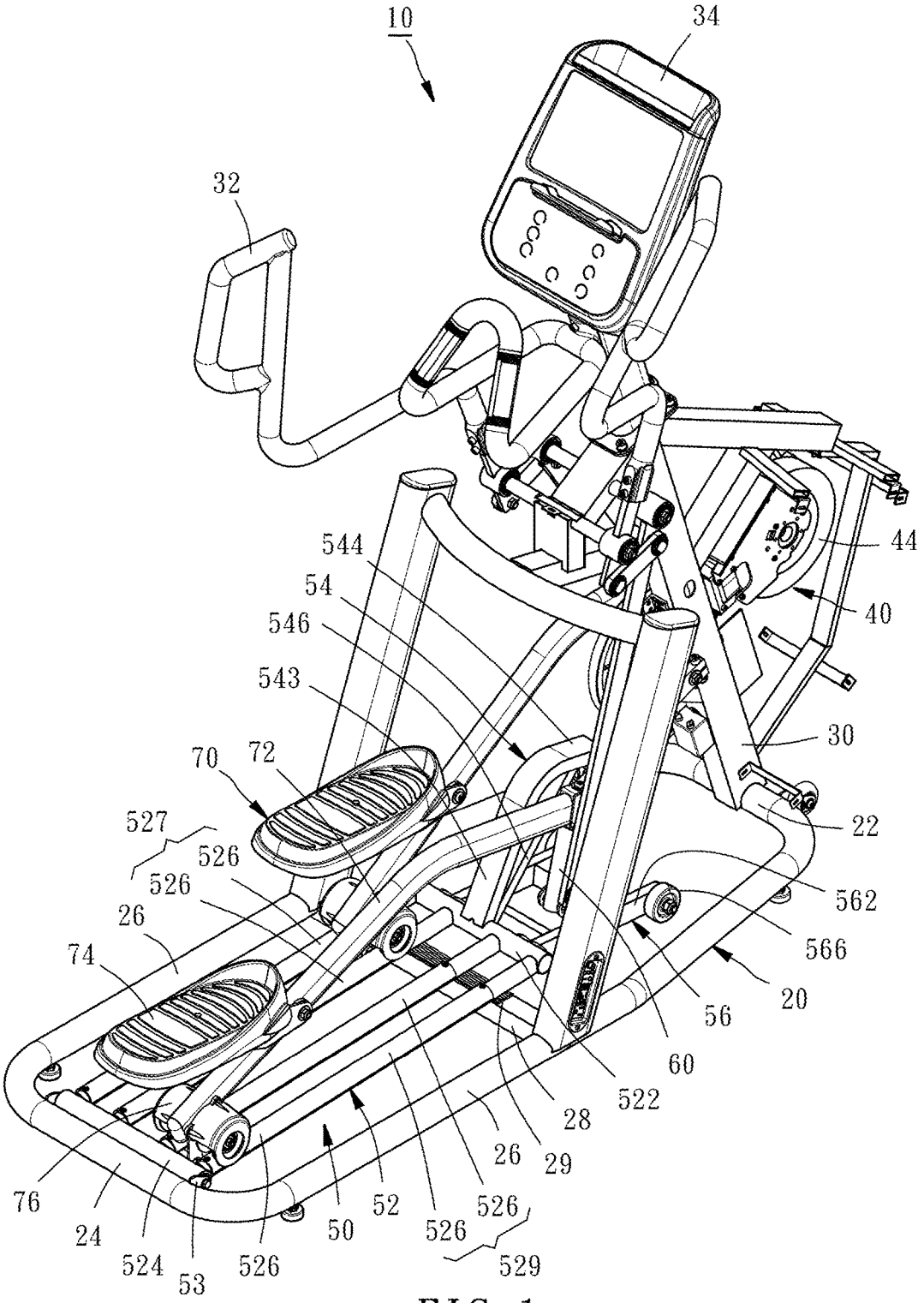
FIG. 1 is an oblique top elevational view of an elliptical trainer in accordance with the present invention.
Figure 2:
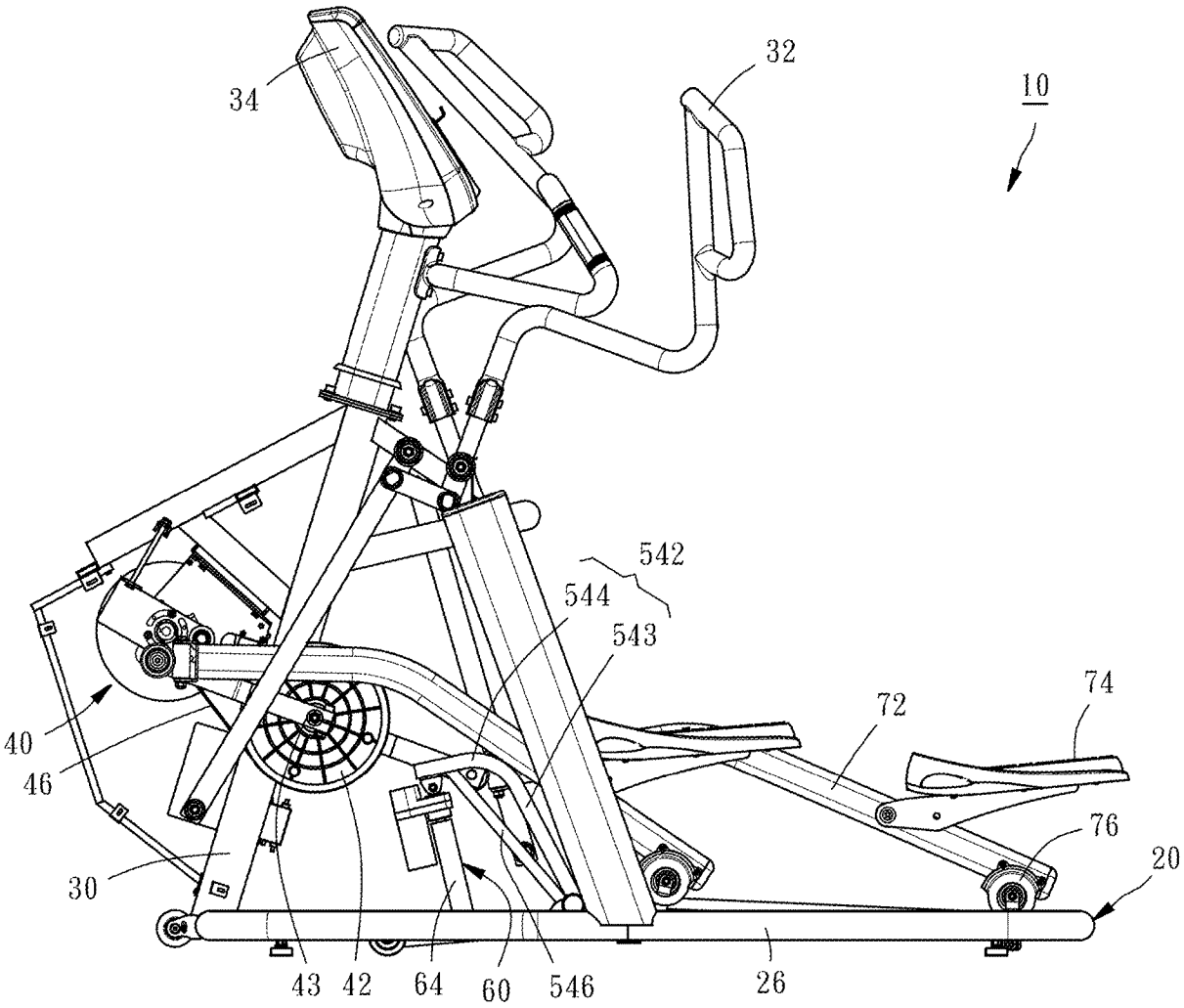
FIG. 2 is a left side view of the elliptical trainer in accordance with the present invention.
Figure 3:
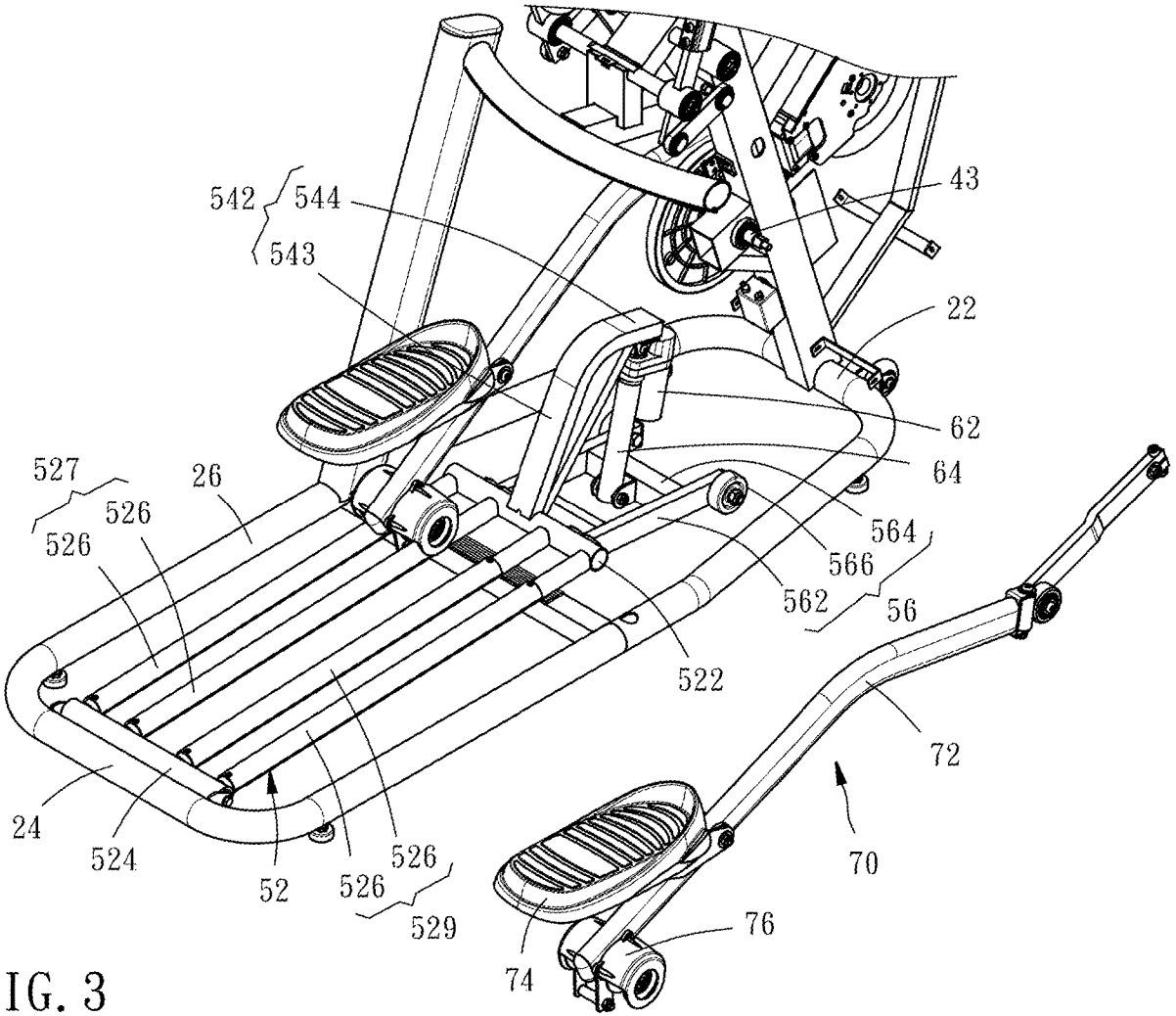
FIG. 3 is an elevational view of a part of the present invention, illustrating an operated status of the retractable device set (I).
Figure 5:
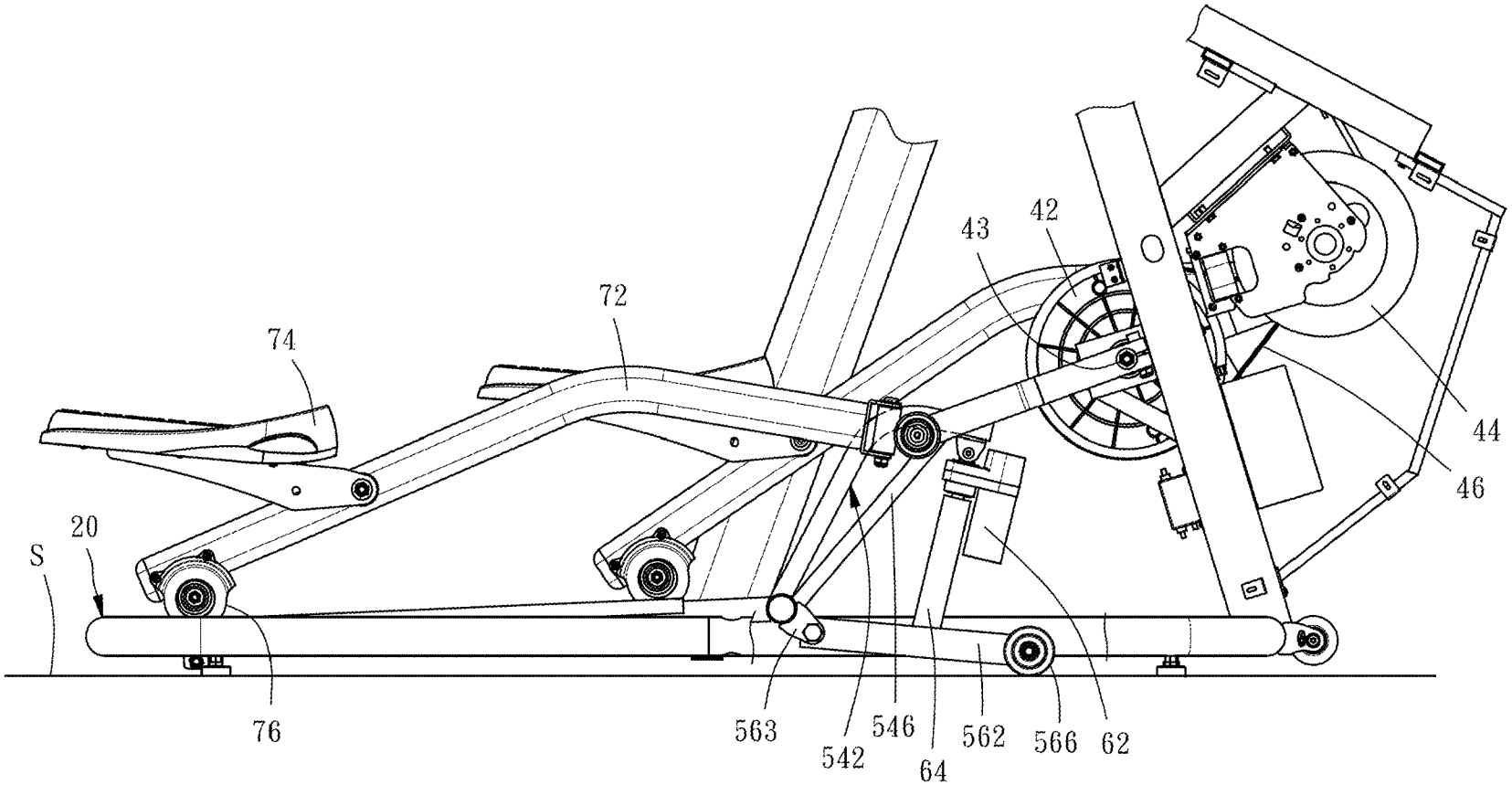
FIG. 5 is a schematic right-side view of the present invention, illustrating an operated status of the retractable device set (I).

Referring to FIGS. 1-3 and 5, an elliptical trainer 10 in accordance with the present invention is shown. The elliptical trainer 10 comprises a base frame 20, a front upright frame 30, a transmission device set 40, a guide rail device set 50, a retractable device set 60 and a pedal device set 70.

The base frame 20 is supported on a bearing surface S, comprising a front connection bar 22, a rear connection bar 24, two opposing side bars 26 and a baffle bar 28. The front connection bar 22 and the rear connection bar 24 are arranged in parallel. Further, the distance between the front connection bar 22 and the rear connection bar 24 can be changed according to the size of the elliptical trainer 10. The two side bars 26 have a respective front end thereof respectively connected to two opposite ends of the front connection bar 22 and a respective rear end thereof respectively connected to two opposite ends of the rear connection bar 24. The baffle bar 28 has two opposite ends thereof respectively connected to the two side bars 26. In this embodiment, the baffle bar 28 is connected between the two side bars 26 on the middle in a parallel manner relative to the front connection bar 22 and the rear connection bar 24. The baffle bar 28 has a top side thereof provided with a buffer plate 29. Further, the lengths and configurations of the front connection bar 22, rear connection bar 24 and side bars 26 can be changed according to different design needs.

The front upright frame 30 is mounted at a front side of the base frame 20 and extended upwards, more specifically, the front upright frame 30 is affixed to the front connection bar 22 to extend upward. Alternatively, the front upright frame 30 can be affixed to the two side bars 26 to extend upward. The front upright frame 30 is adapted for supporting two handles 32, a display panel 34 and the transmission device set 40. Further, the configuration and structure of the front upright frame 30 are not limited to that shown in the annexed drawings and described in the specification.

The transmission device set 40 is mounted at the front upright frame 30, comprising, but not limited to, a flywheel 42 and a transmission wheel 44. The transmission wheel 44 is adapted for driving the flywheel 42 to rotate via a transmission belt 46. The flywheel 42 comprises an output axle 43. The output axle 43 is located on the center of the flywheel 42 for synchronous rotation with the flywheel 42.

The guide rail device set 50 is mounted within the base frame 20 between the front connection bar 22 and the rear connection bar 24 and also between the two side bars 26. The guide rail device set 50 comprises a guide rail seat 52, an upper support unit 54 and a lower support unit 56. The guide rail seat 52 has a rear side thereof pivotally connected to an opposing rear side of the base frame 20 so that the guide rail seat 52 can be biased up and down relative to the rear side of the base frame 20. The upper support unit 54 is affixed to an opposing front side of the guide rail seat 52. The lower support unit 56 is pivotally connected to the front side of the guide rail seat 52 and can be biased up and down relative to the front side of the guide rail seat 52.

More specifically, the guide rail seat 52 comprises a front rod member 522, a rear rod member 524 and a plurality of slide rods 526. The rear rod member 524 is disposed transversely and on a side of the rear connection bar 24 facing the front connection bar 22. The rear rod member 524 has two opposite ends thereof pivotally connected to the rear connection bar 24 by a pivot joint 53, allowing rotation of the rear rod member 524 on the axis thereof. In this embodiment, the number of the slide rods 526 is 4, however, this number is not a limitation. Each slide rod 526 has a rear end thereof fixedly connected to the rear rod member 524, and an opposing front end thereof fixedly connected to the front rod member 522. It's worth mentioning that the two slide rods 526 near the left-sided side bar 26 create a left slide rail 527; the other two slide rods 526 near the right-sided side bar 26 create a right slide rail 529. Further, the baffle bar 28 is transversely disposed below the slide rods 526. When the guide rail seat 52 is biased downward, the slide rods 526 will be stopped at the baffle bar 28 and abutted against the buffer plate 29.

The upper support unit 54 extends obliquely upwardly in direction toward the front side of the base frame 20. More specifically, the upper support unit 54 comprises an upper support member 542 and an intermediate support member 546. The upper support member 542 comprises a connection segment 543 and an extension segment 544. The connection segment 543 has a bottom end thereof fixedly connected to the front rod member 522, and an opposing top end thereof extending obliquely upwards toward the front side of the base frame 20. The extension segment 544 is fixedly connected to the front end of the connection segment 543 and transversely extending toward the front side of the base frame 20. In the present preferred embodiment, the connection segment 543 and the extension segment 544 are made in one piece. Alternatively, the connection segment 543 and the extension segment 544 can be separated members fixedly connected by welding. The intermediate support member 546 has two opposite ends thereof respectively affixed to the front rod member 522 and the extension segment 544 to enhance the connection strength and structural stability between the upper support member 542 and the front rod member 522.

The lower support unit 56 extends toward the front side of the base frame 20. More specifically, the lower support unit 56 comprises two lower support members 562, a connection member 564 and two rollers 566. In the present preferred embodiment, the lower support members 562 and the connection member 564 are rod members. The lower support members 562 are arranged in parallel and spaced from each other by a predetermined distance. This predetermined distance can be changed according to different needs. The two lower support members 562 have a respective rear end thereof pivotally connected to the front rod member 522 by a pivot connection device 563 so that the two lower support members 562 can be biased up and down relative to the front rod member 522. Further, the two lower support members 562 extend toward the front side of the base frame 20. The two rollers 566 are respectively pivotally connected to respective front ends of the lower support members 562 and rotatable on the bearing surface S. The connection member 564 is disposed perpendicular to the two lower support members 562, having two opposite ends thereof respectively affixed to the lower support members 562 for allowing the two lower support members 562 to be biased synchronously up and down.

The retractable device set 60 is mounted between the upper support unit 54 and the lower support unit 56 with two opposite ends thereof respectively pivotally connected to the upper support unit 54 and the lower support unit 56. More specifically, the retractable device set 60 comprises a power unit 62, and a retractable bar 64 coupled to the power unit 62. The power unit 62 can be an electrical motor, pneumatic cylinder or hydraulic cylinder. The power unit 62 is operable to drive the retractable bar 64 and to control the extending length of the retractable bar 64, causing the retractable device set 60 to extend out or to retract. The power unit 62 is pivotally connected to the extension segment 544. The retractable bar 64 is pivotally connected to the connection member 564.

The pedal device set 70 is connected to the transmission device set 40 and slidably supported on the guide rail seat 52. More specifically, the pedal device set 70 comprises two link units 72, two pedals 74 and two roller sets 76. The two link units 72 are respectively disposed at opposing left and right sides relative to the flywheel 42 with a respective front end thereof coupled to the output axle 43 of the flywheel 42 so that the two link units 72 are drivable by the flywheel 42 to move synchronously. The two link units 72 respectively extend toward the left slide rail 527 and the right slide rail 529. The two pedals 74 are respectively fixedly mounted on the link units 72 for pedaling by the user. The two roller sets 76 are respectively mounted to respective rear ends of the link units 72, and respectively slidably supported on the left slide rail 527 and the right slide rail 529 that are respectively constituted by the slide rods 526. During rotation of the flywheel 42, the output axle 43 drives the two link units 72, the two pedals 74 and the two roller sets 76 to move, causing the pedals 74 to move in an approximately oval trajectory. Since the related technical content of how the pedal 74 forms an approximate elliptical trajectory is of the known art, details are not described herein again.

Figure 4:
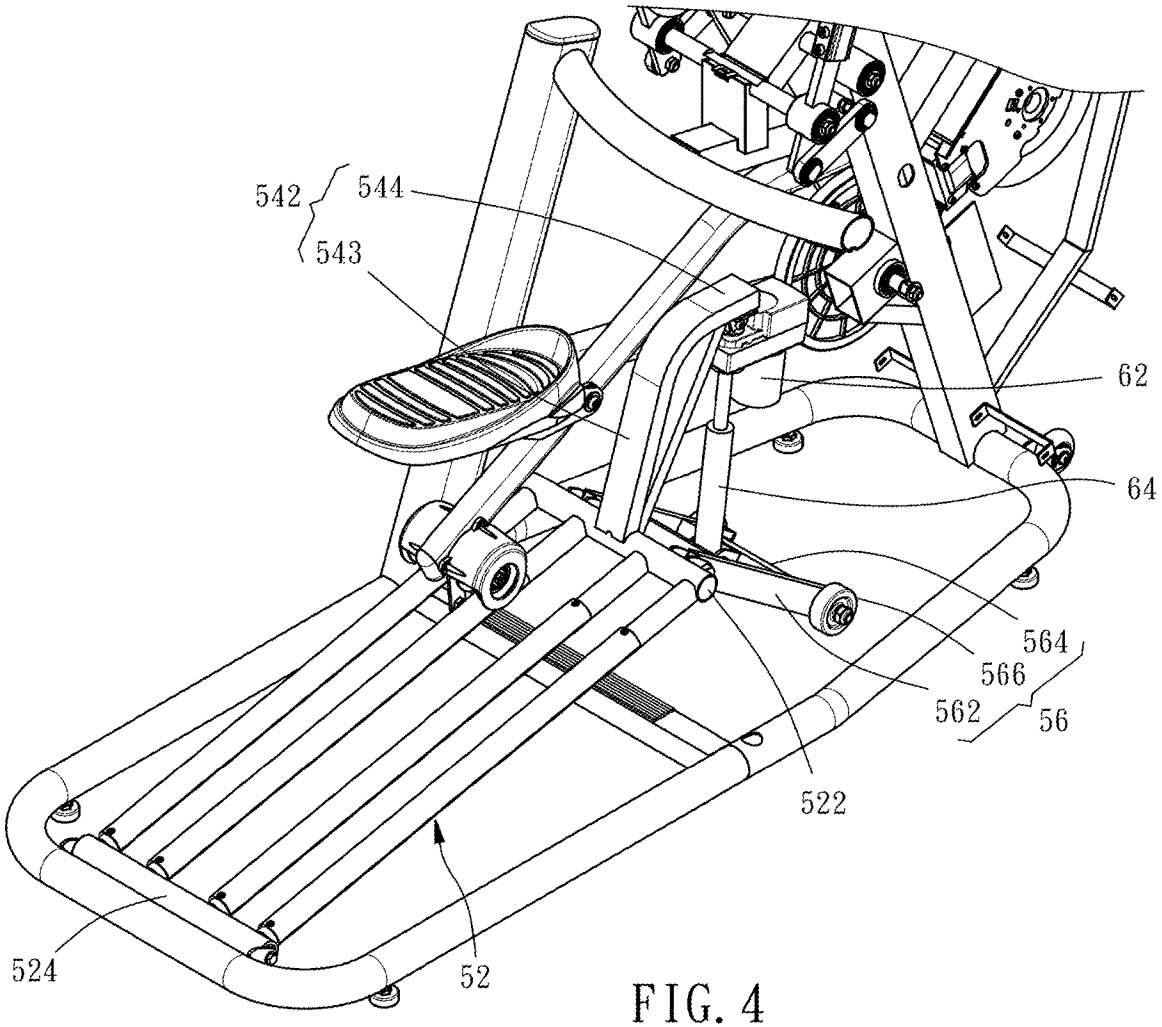
FIG. 4 is an elevational view of a part of the present invention, illustrating an operated status of the retractable device set (II).
Figure 6:
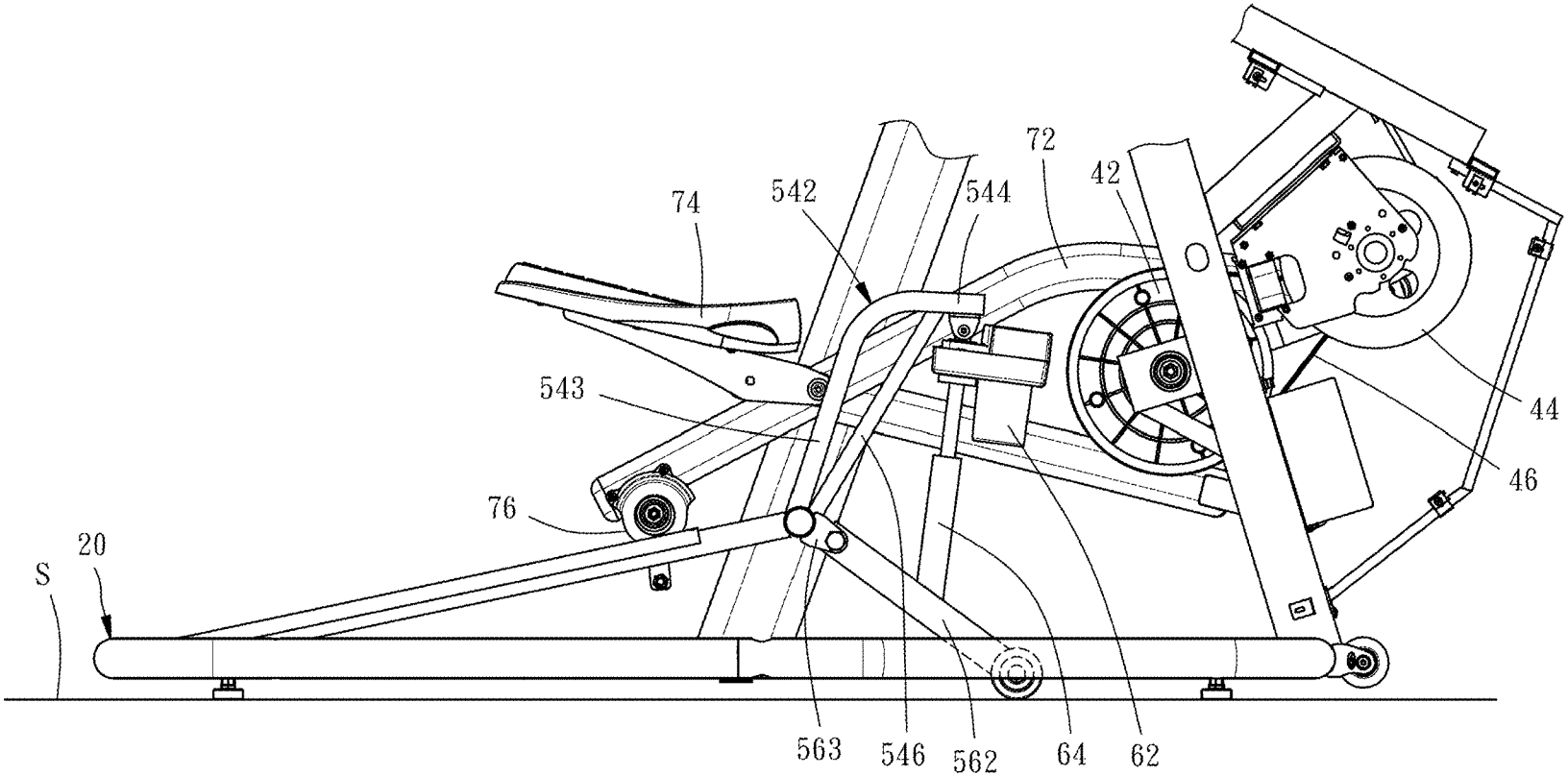
FIG. 6 is a schematic right-side view of the present invention, illustrating an operated status of the retractable device set (II).

Referring to FIGS. 3-4 and FIG. 5-6, when the user adjusts the power unit 62 to control the retractable bar 64 to project downwardly, the retractable device set 60 pushes the lower support unit 56 to pivot due to the upper support unit 54 being affixed to the guide rail seat 52, thereby raising the guide rail seat 52 and changing the angle at which the guide rail seat 52 bias relative to the rear side of the base frame 20. Since the pedal device set 70 is slidably supported on the guide rail seat 52, the trajectory formed by the movement of the pedals 74 can be changed. Similarly, when the user adjusts the power unit 62 to control the retractable bar 64 to project upwardly, the lower support unit 56 will pivot upwards to lower the lifting height of the guide rail seat 52, thereby reducing the height of the pedals 74. In conclusion, by means of adjusting the lifting angles of the retractable device set 60 and the controllable guide rail seat 52, not only the diversified training needs of the user can be met, but also the richness of the training contents can be enhanced.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An elliptical trainer, comprising:

a base frame defining a front side and an opposing rear side;

a front upright frame mounted at the front side of said base frame and extends upwards;

a transmission device set mounted at said front upright frame;

a guide rail device set disposed within said base frame, said guide rail device set comprising a guide rail seat, an upper support unit and a lower support unit, said guide rail seat having a rear side thereof pivotally connected to the rear side of said base frame for allowing said guide rail seat to be biased up and down relative to the rear side of said base frame, said upper support unit being fixedly connected to the front side of said guide rail seat, said lower support unit being pivotally connected to the front side of said guide rail seat and biasable up and down relative to the front side of said guide rail seat;

a retractable device set having two opposite ends thereof respectively pivotally connected to said upper support unit and said lower support unit, said retractable device set being retractable to adjust the upward and downward pivoting angle of said guide rail seat relative to the rear side of said base frame; and a pedal device set connected to said transmission device set and slidably supported on said guide rail seat.

2. The elliptical trainer as claimed in claim 1, wherein said upper support unit extends obliquely upwards toward the front side of said base frame; said lower support unit extends toward the front side of said base frame; said retractable device set is disposed between said upper support unit and said lower support unit.

3. The elliptical trainer as claimed in claim 2, wherein said upper support unit comprises an upper support member, said upper support member comprising a connection segment and an extension segment, said connection segment having a bottom end thereof fixedly connected to the front side of said guide rail seat and an opposing top end obliquely upwardly extending toward the front side of said base frame, said extension segment being fixedly connected to the top end of said connection segment and extending transversely toward the front side of said base frame; said retractable device set is pivotally connected to said extension segment.

4. The elliptical trainer as claimed in claim 3, wherein said upper support unit further comprises an intermediate support member, said intermediate support member having two opposite ends thereof respectively fixedly connected to the front side of said guide rail seat and said extension segment.

5. The elliptical trainer as claimed in claim 2, wherein said lower support unit comprises two lower support members and a connection member, said two lower support members being spaced from each other by a predetermined distance and pivotally connected to the front side of said guide rail seat, said connection member having two opposite ends thereof respectively fixedly connected to said two lower support members; said retractable device set is pivotally connected to said connection member.

6. The elliptical trainer as claimed in claim 5, wherein said lower support unit further comprises two rollers respectively pivotally connected to one respective said lower support member.

7. The elliptical trainer as claimed in claim 2, wherein said retractable device set comprises a power unit pivotally connected to said upper support unit and a retractable bar coupled to said power unit, said power unit being adapted for driving said retractable bar and controlling the extending length of said retractable bar, said retractable bar being pivotally connected with one end thereof to said lower support unit.

8. The elliptical trainer as claimed in claim 2, wherein said guide rail seat comprises a front rod member, a rear rod member and a plurality of slide rods, said rear rod member being disposed transversely and having two opposite ends thereof pivotally connected to the rear side of said base frame, each said slide rod having a rear end thereof fixedly connected to said rear rod member and an opposing front end thereof fixedly connected to said front rod member; said upper support unit is fixedly connected to said front rod member; said lower support unit is pivotally connected to said front rod member; said pedal device set is slidably supported on said slide rods.

9. The elliptical trainer as claimed in claim 8, wherein said base frame comprises a front connection bar, a rear connection bar and two side bars, said two side bars having a respective front end thereof respectively connected to two opposite ends of said front connection bar and a respective opposing rear end thereof respectively connected to two opposite ends of said rear connection bar; said rear rod member has the two opposite ends thereof pivotally connected to said rear connection bar; said front upright frame is fixedly connected to said front connection bar.

10. The elliptical trainer as claimed in claim 9, wherein said base frame further comprises a baffle bar transversely disposed below said slide rods, said baffle bar having two opposite ends thereof respectively connected to said two side bars.

* * * * *